US009683423B2

(12) United States Patent
Xu

(10) Patent No.: US 9,683,423 B2
(45) Date of Patent: Jun. 20, 2017

(54) DEGRADABLE PLUG WITH FRICTION RING ANCHORS

(71) Applicant: BAKER HUGHES INCORPORATED, Houston, TX (US)

(72) Inventor: YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 467 days.

(21) Appl. No.: 14/258,646

(22) Filed: Apr. 22, 2014

(65) Prior Publication Data

US 2015/0300121 A1 Oct. 22, 2015

(51) Int. Cl.

| | |
|---|---|
| ***E21B 33/128*** | (2006.01) |
| ***E21B 33/129*** | (2006.01) |
| ***E21B 29/02*** | (2006.01) |
| ***E21B 33/134*** | (2006.01) |
| ***E21B 33/12*** | (2006.01) |

(52) U.S. Cl.

CPC ..... *E21B 33/1208* (2013.01); *E21B 29/02* (2013.01); *E21B 33/128* (2013.01); *E21B 33/129* (2013.01); *E21B 33/1291* (2013.01); *E21B 33/134* (2013.01); *E21B 33/1285* (2013.01)

(58) Field of Classification Search

CPC .. E21B 33/1208; E21B 29/02; E21B 33/1291; E21B 33/128; E21B 33/129; E21B 33/134

See application file for complete search history.

(56) References Cited

U.S. PATENT DOCUMENTS

| | | | | |
|---|---|---|---|---|
| 2,230,712 | A * | 2/1941 | Bendeler | E21B 33/128 166/123 |
| 2,546,377 | A * | 3/1951 | Turechek | E21B 33/1293 166/134 |
| 4,934,459 | A * | 6/1990 | Baugh | E21B 23/01 166/380 |
| 5,709,269 | A | 1/1998 | Head | |
| 6,712,153 | B2 * | 3/2004 | Turley | E21B 33/1208 166/118 |
| 6,769,491 | B2 * | 8/2004 | Zimmerman | E21B 33/1204 166/138 |
| 6,793,022 | B2 * | 9/2004 | Vick | E21B 33/129 166/118 |
| 7,168,494 | B2 | 1/2007 | Starr et al. | |
| 7,350,582 | B2 | 4/2008 | McKeachnie et al. | |
| 8,579,024 | B2 | 11/2013 | Mailand et al. | |
| 8,997,882 | B2 * | 4/2015 | Turley | E21B 33/1216 166/208 |

(Continued)

*Primary Examiner* — Blake Michener

(74) *Attorney, Agent, or Firm* — Steve Rosenblatt

(57) ABSTRACT

A disintegrating plug features anchoring with friction rings that are expanded during the setting to contact the tubular. The design is modular and can integrate as many friction rings as needed to fixate the plug against the anticipated treating pressures from above when a ball is landed on the seat of the plug. The friction rings can be standalone or integrated with an adjacent ramp for the next friction ring. The friction rings are made from a disintegrating material along with other parts of the plug so that when the treating procedure is completed the plugs will substantially disappear to facilitate subsequent production. A fracking application is contemplated.

21 Claims, 3 Drawing Sheets

(56) References Cited

U.S. PATENT DOCUMENTS

2004/0216868 A1* 11/2004 Owen, Sr. ..... E21B 23/06
166/134
2010/0038072 A1* 2/2010 Akselberg ..... E21B 33/128
166/118
2010/0326675 A1* 12/2010 Doane ..... E21B 33/128
166/387
2011/0048743 A1 3/2011 Stafford et al.
2011/0136707 A1* 6/2011 Xu ..... C22C 1/04
507/270
2013/0186616 A1* 7/2013 Xu ..... E21B 33/129
166/212
2013/0186648 A1* 7/2013 Xu ..... E21B 23/01
166/382
2013/0186650 A1* 7/2013 Xu ..... E21B 23/01
166/386
2013/0299192 A1* 11/2013 Xu ..... E21B 23/01
166/382
2014/0041857 A1* 2/2014 Xu ..... E21B 33/128
166/118
2014/0054041 A1* 2/2014 Schultz ..... E21B 34/14
166/308.1
2014/0196889 A1* 7/2014 Oberg ..... E21B 23/01
166/206
2015/0053428 A1* 2/2015 Xu ..... E21B 33/1293
166/386
2015/0060085 A1* 3/2015 Xu ..... E21B 33/12
166/376
2015/0129215 A1* 5/2015 Xu ..... E21B 23/06
166/285
2015/0129239 A1* 5/2015 Richard ..... E21B 23/06
166/377

* cited by examiner

DEGRADABLE PLUG WITH FRICTION RING ANCHORS

FIELD OF THE INVENTION

The field of the invention is treatment plugs that are selectively closed to isolate lower zones so that the zone above the plug can be treated and more particularly plugs that disintegrate while using friction for anchoring rather than hard materials that penetrate for grip but do not disintegrate. A fracking application is also contemplated.

BACKGROUND OF THE INVENTION

One type of fracturing method involves setting a series of plugs that have progressively larger ball seats. As the lowest zone is fracked a ball is dropped to effectively isolate the interval just fracked and pressure is applied to the seated ball so that that the next interval above in the borehole can be fracked. This process is repeated with progressively larger balls that sequentially land on seats on plugs moving closer to the surface. Eventually all the intervals are fractured and the various plugs need to be removed for producing the interval. More prevalent currently is a fracturing method where a plug is set, the borehole is perforated, a ball is circulated ball onto the plug, pressure is built up to treat the zone; then another plug is set above the recently treated zone and the process is repeated. In this method the seats and matching balls do not need to be progressively larger because there are no balls to pass through other plugs. Instead each ball lands on its own plug directly without having to pass through restrictions in other plugs.

Controlled electrolytic materials have been described in US Publication 2011/0136707 and related applications filed the same day. The related applications are incorporated by reference herein as though fully set forth. The listed published application specification and drawings are literally included in this specification to provide an understanding of the materials considered to be encompassed by the term "controlled electrolytic materials" or CEM for short. These materials have been used to make barriers disintegrate in fracking applications.

The frack plugs in the past have had anchoring slips that feature wickers and hardened inserts to obtain sufficient grip to withstand the high differential pressures that are seen in fracking operations. These slips were necessarily of a material that would not disintegrate. This caused imperfect removal of the plugs after fracturing and before production. The present invention addresses this issue by using a plug design that features radial expansion and anchoring rings and a seal that are set in that manner, where the anchoring rings rely on friction forces to resist differential pressures during fracking but thereafter can disintegrate so that subsequent production is not inhibited by incomplete removal of the fracking barriers. While fracking is the preferred use other well treating applications are contemplated. These and other aspects of the present invention will be more readily apparent to those skilled in the art from a review of the description of the preferred embodiments and associated drawings while recognizing that the full scope of the invention is to be determined from the appended claims.

SUMMARY OF THE INVENTION

A disintegrating plug features anchoring with friction rings that are expanded during the setting to contact the tubular. The design is modular and can integrate as many friction rings as needed to fixate the plug against the anticipated treating pressures from above when a ball is landed on the seat of the plug. The friction rings can be standalone or integrated with an adjacent ramp for the next friction ring. The friction rings are made from a disintegrating material along with other parts of the plug so that when the treating procedure is completed the plugs will substantially disappear to facilitate subsequent production. A fracking application is contemplated.

DETAILED DESCRIPTION OF THE PREFERRED EMBODIMENT

Figure 1:
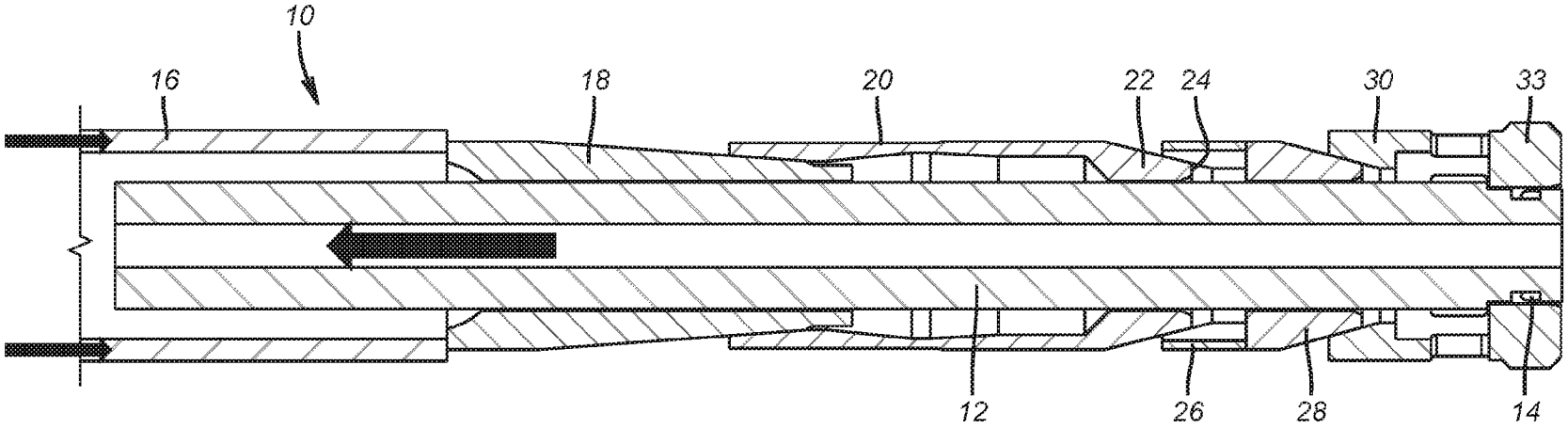
FIG. 1 is a section view showing two friction rings and in a run in condition.

FIG. 1 shows a treating plug 10 secured to a mandrel 12 at shear pins 14. A setting sleeve 16 is part of a wireline running tool that can put a force down on sleeve 16 while holding mandrel 12 to set the plug 10 and release the mandrel 12 at the same time. Such wireline setting tools are known in the art and one example is an E-4 setting tool made by Baker Hughes Incorporated. In operation sleeve 16 is pushed down while mandrel 12 is retained. As a result seal cone 18 is pushed down taking with it the expandable seal 20 that has a cone 22 integrated into its leading end 24. Ring 26 is a friction ring disposed to ride up cone 22 to contact the tubular that is not shown. Ring 26 also pushes on cone 28 on which rides friction ring 30. Integrated into the lower end of friction ring 30 is a bushing 33 where pins 14 selectively retain the mandrel 12. The seal 20 and ring 26 and additional friction rings that may be used are plastically expanded in a radial direction for the set position. Treatment contemplates fracking, stimulation or other downhole pressure operations.

The rings 26 and 30 can be complete rings or segments. They can be scored or joined as segments that complete a ring shape and that spread apart into discrete segments or just deform more at pre-scored locations. The design in FIG. 1 is modular so that cones and friction rings can appear in an alternating pattern. While a single cone pushing a single friction ring or segment structure is preferred, it is also possible to have a single cone push a plurality of such stacked structures.

Figure 2:
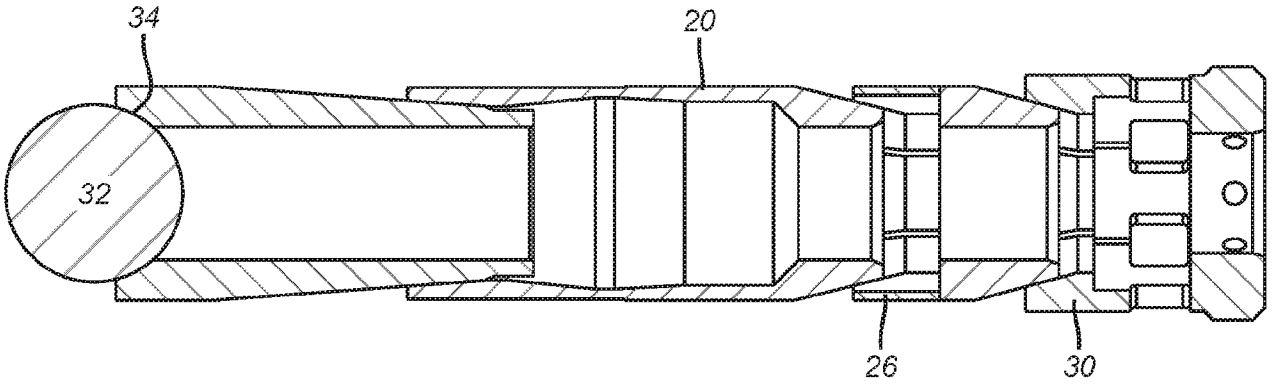
FIG. 2 is the view of FIG. 1 with a ball landed on the seat of the seal cone.

FIG. 2 shows the set position for the design in FIG. 1 where now the mandrel 12 has been removed, the friction rings 26 and 30 have been extended by wedging action as well as the seal 20. At this point a ball 32 is landed on seat 34 and pressure is applied against the seated ball 32 to frack or otherwise treat such as in stimulation the interval above the seated ball 32. The process repeats higher in the well.

Figure 3:
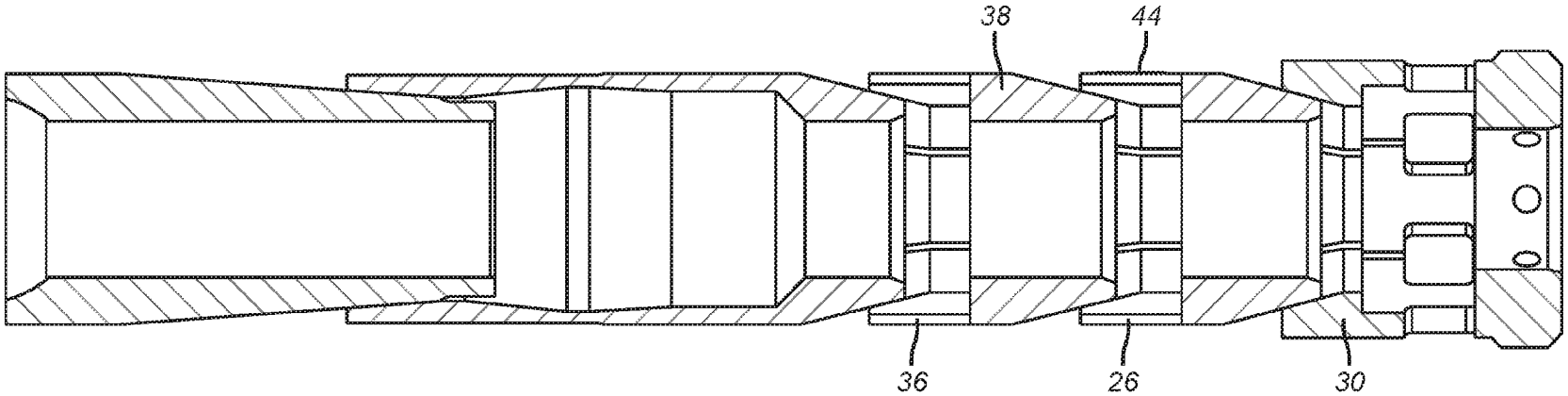
FIG. 3 is an alternative to FIG. 1 showing an additional friction ring.
Figure 4:
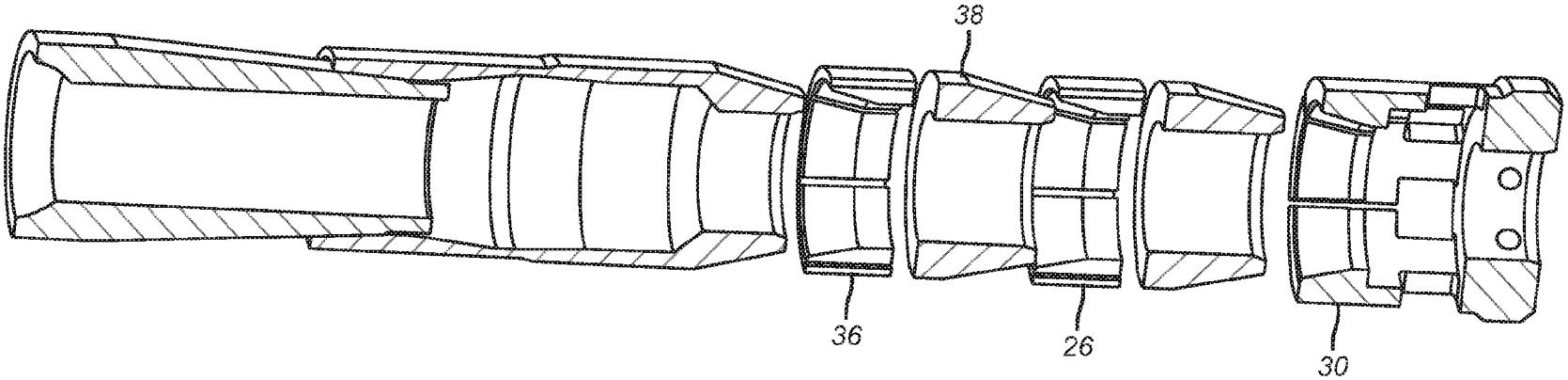
FIG. 4 is an exploded view of FIG. 3.
Figure 5:
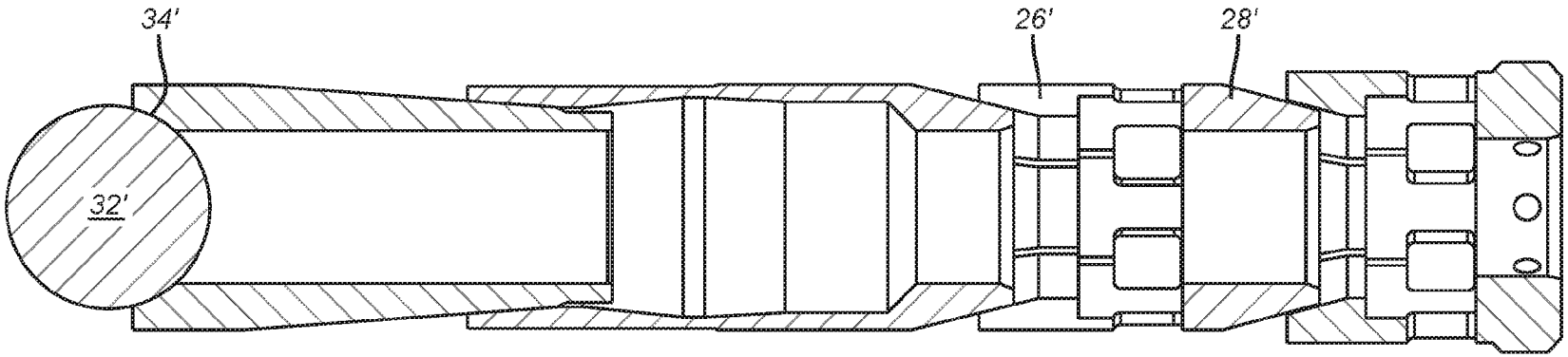
FIG. 5 is an alternative to FIG. 1 showing a friction ring integrated with an adjacent cone that expands another friction ring on the plug.
Figure 6:
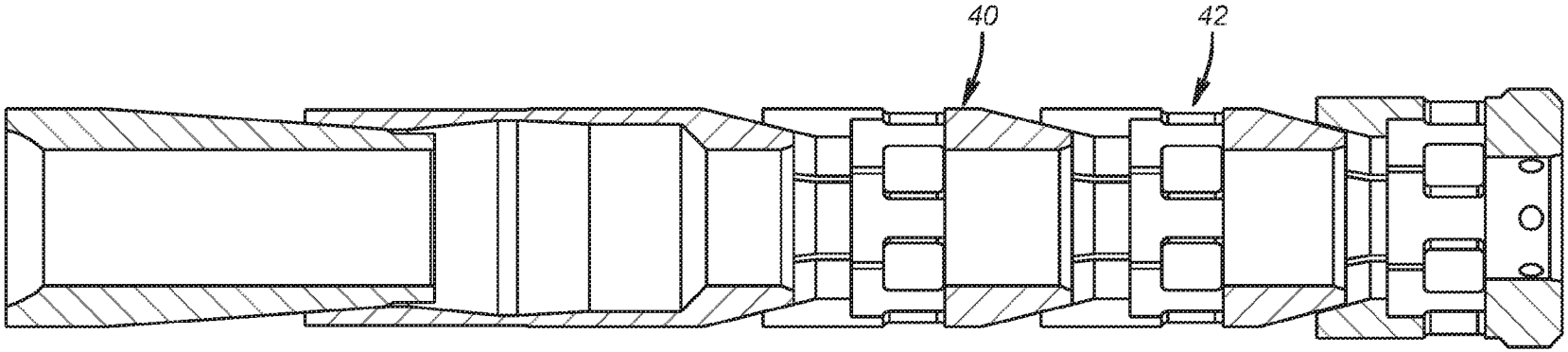
FIG. 6 is an alternative to FIG. 5 showing an additional friction ring integrated with an adjacent cone.

FIGS. 3 and 6 show the modular nature of the assembly with the addition of another friction ring 36 and another cone 38. FIG. 5 shows a variation of FIG. 2 with the mandrel out and the ball 32' landed on seat 34'. Another difference is that FIG. 5 shows integration of friction ring 26' with cone 28' in a single piece. Here again the integrated cone and friction ring design is modular as shown in FIG. 6 where two integrated cone and friction ring assemblies are shown as 40 and 42.

The plug 10 is made of fully disintegrating materials and preferably controlled electrolytic material CEM is to be used. Under predetermined well conditions the plug 10 will simply disintegrate into small components so that the remnants can either be circulated out or allowed to go down the borehole. By virtue of the use of friction rings or segments the anchoring can be accomplished with a disintegrating material while still providing the needed anchoring force to hold the differential pressures seen in fracking. Optionally to enhance grip, the friction rings can have a surface roughening shown schematically as 44.

The plug design that employs friction anchoring allows for using fully disintegrating components as opposed to prior slips designs that used cast iron for slips or used hardened inserts such as carbide or hardened wickers made of carbide or employing diamond inserts.

The plug is set with relative axial movement that then employs a wedging action to increase the diameter of the sealing element and however many friction rings are used. The modular design allows adding as many friction rings as needed to withstand the differential pressure during the fracking operation. The plugs have open passages when the running tool mandrel 12 is removed and that passage is closed with a dropped ball to allow pressure buildup above.

While CEM is the preferred material for plug components other materials that degrade or disintegrate with well fluid exposure or thermal exposure can also be used.

The plug has no mandrel when it is set and the wireline setting tool is pulled out of the components, all of which define the through passage of the plug.

The above description is illustrative of the preferred embodiment and many modifications may be made by those skilled in the art without departing from the invention whose scope is to be determined from the literal and equivalent scope of the claims below:

I claim:

1. A subterranean plug assembly for treating formations in a borehole defined by a tubular, comprising:

an expandable seal having a passage therethrough in direct contact with a seal expander comprising a tapered outer surface thereon, said seal expander initially disposed at least in part within said expandable seal;

said seal expander wedging said expandable seal radially by an axial relative movement with respect to the length of said expandable seal, by moving further within said expandable seal;

at least one friction ring assembly adjacent said expandable seal;

said expandable seal and friction ring assembly selectively plastically deformed into contact with the tubular in response to relative movement of said seal expander;

said friction ring assembly supporting said seal when said seal is set and pressure differential is applied to the plug with said passage selectively obstructed;

said seal, expander and friction ring assembly are made of a disintegrating material for selective removal from the tubular.

2. The assembly of claim 1, wherein:

said seal expands said friction ring assembly.

3. The assembly of claim 1, wherein:

said at least one friction ring assembly comprises a plurality of friction ring assemblies.

4. The assembly of claim 3, wherein:

said friction ring assemblies are spaced apart.

5. The assembly of claim 4, further comprising:

cone expanders between at least two spaced friction ring assemblies.

6. The assembly of claim 3, wherein:

at least one friction ring assembly is built in one piece with a ramp surface for expanding a contacting friction ring assembly.

7. The assembly of claim 1, wherein:

said friction ring assembly has exterior surface roughness.

8. The assembly of claim 1, wherein:

said disintegrating material comprises a controlled electrolytic material.

9. The assembly of claim 1, further comprising:

a running tool mandrel selectively secured in said passage and further comprising an actuation sleeve in movable contact with said seal expander;

whereupon relative movement between said mandrel and said actuation sleeve, said friction ring assembly and said seal are radially deformed and said mandrel is released for removal from said passage.

10. The assembly of claim 1, wherein:

said seal expander further comprises a seat to accept an object to selectively block said passage.

11. The assembly of claim 1, wherein:

said friction ring assembly comprises a closed ring shape.

12. The assembly of claim 11, wherein:

said ring shape further comprises scores to facilitate expansion thereof.

13. The assembly of claim 1, wherein:

said friction ring assembly comprises a plurality of segments initially defining a closed ring shape and separating on expansion toward the tubular.

14. A subterranean plug assembly for treating formations in a borehole defined by a tubular, comprising:

an expandable seal having a passage therethrough adjacent a seal expander comprising a tapered outer surface thereon;

said seal expander wedging said expandable seal radially by an axial relative movement with respect to the length of said expandable seal;

at least one friction ring assembly adjacent said expandable seal;

said expandable seal and friction ring assembly selectively plastically deformed into contact with the tubular in response to relative movement of said seal expander;

said friction ring assembly supporting said seal when said seal is set and pressure differential is applied to the plug with said passage selectively obstructed;

said seal, expander and friction ring assembly are made of a disintegrating material for selective removal from the tubular;

said seal has an end taper for direct expansion of said friction ring assembly.

15. A subterranean plug assembly for treating formations in a borehole defined by a tubular, comprising:

an expandable seal having a passage therethrough adjacent a seal expander comprising a tapered outer surface thereon;

said seal expander wedging said expandable seal radially by an axial relative movement with respect to the length of said expandable seal;

at least one friction ring assembly adjacent said expandable seal;

said expandable seal and friction ring assembly selectively plastically deformed into contact with the tubular in response to relative movement of said seal expander;

said friction ring assembly supporting said seal when said seal is set and pressure differential is applied to the plug with said passage selectively obstructed;

said seal, expander and friction ring assembly are made of a disintegrating material for selective removal from the tubular;

said seal, seal expander and at least one friction ring assembly directly define said passage structurally.

16. The assembly of claim 15, wherein:

said seal has an end taper for direct expansion of said friction ring assembly.

17. The assembly of claim 16, wherein:

said at least one friction ring assembly comprises a plurality of friction ring assemblies.

18. The assembly of claim 16, wherein:

said friction ring assemblies are spaced apart.

19. The assembly of claim 18, further comprising:

cone expanders between at least two spaced friction ring assemblies.

20. The assembly of claim 16, wherein:

at least one friction ring assembly is built in one piece with a ramp surface for expanding a contacting friction ring assembly.

21. The assembly of claim 15, wherein:

said seal, expander and friction ring assembly disintegrate from exposure to existing well fluids or thermal input from said existing well fluids.

* * * * *